United States Patent [19]

Lutzenberger et al.

[11] Patent Number: 4,755,641

[45] Date of Patent: Jul. 5, 1988

[54] PAWL CONTROLLED SWITCH

[75] Inventors: Kurt Lutzenberger, Arlington Heights; Arnold A. Case, West Chicago, both of Ill.

[73] Assignee: Switchcraft, Inc., Chicago, Ill.

[21] Appl. No.: 40,504

[22] Filed: Apr. 20, 1987

[51] Int. Cl.[4] ..... H01H 3/00

[52] U.S. Cl. ..... 200/153 J; 200/328; 74/128; 188/83

[58] Field of Search ..... 200/153 J, 328, 340; 188/83, 166; 74/128; 401/110, 111

[56] References Cited

U.S. PATENT DOCUMENTS

| | | | |
|---|---|---|---|
| 2,294,516 | 9/1942 | Smith | 188/83 |
| 3,052,421 | 9/1962 | Fischer | 188/83 |
| 4,382,167 | 5/1983 | Maruyama et al. | 200/153 J |
| 4,495,391 | 1/1985 | Kitao et al. | 200/153 J |

*Primary Examiner*—Henry J. Recla
*Assistant Examiner*—Linda J. Sholl
*Attorney, Agent, or Firm*—John T. Meaney; Richard M. Sharkansky

[57] ABSTRACT

A control device comprising an electrical switch having an actuator disposed for reciprocal movement in a housing and provided with a substantially planar surface whereon a pawl is mounted for rotation in a plane adjacent the planar surface. The pawl includes a plurality of cam surface portions disposed for engagement with projections within the housing to convert reciprocal movement of the actuator into controlled rotary movement of the pawl in a uniform direction and thereby determine the sequence of operating conditions produced by the actuator. At least one pair of resilient arms extend from respective opposing portions of the pawl and into resilient pressure engagement with the substantially planar surface for exerting respective balanced tensile forces on the opposing portions of the pawl and enabling the pawl to resist free rotary movements and permit controlled rotary movements thereof.

20 Claims, 4 Drawing Sheets

PAWL CONTROLLED SWITCH

BACKGROUND OF THE INVENTION

1. Field of the Invention

This invention relates generally to control devices having pawl regulated actuators and is concerned more particularly with an electrical switch having a reciprocally movable actuator regulated by a continuously controlled pawl.

2. Discussion of the Prior Art

There has been developed in the prior art an electrical switch having a pushbutton actuator provided with a shaft driven plunger which is disposed for reciprocal movement in a switch housing. The plunger is spring-biased to return, when released, toward a position of maximum shaft extension from the housing where the switch is disposed in a first operating condition. Within the housing, the plunger carries a pawl which is rotated when the plunger is pressed fully into the housing and released. The orientation of the pawl determines whether the plunger will return to the position of maximum shaft extension or be locked in a position of partial shaft extension where the switch is disposed in a second operating condition.

In accordance with design strategy, the plunger is pressed from its position of maximum shaft extension and fully into the housing where it is then released. As a result, the pawl should be rotated in a predetermined direction to orient it properly for locking the returning plunger in the position of partial shaft extension and disposing the switch in the second operating condition. Subsequently, the plunger is pressed from its position of partial shaft extension and fully into the housing where it is released again. Consequently, the pawl should be rotated in the same predetermined direction to orient it properly for permitting the returning plunger to travel to its position of maximum shaft extension and disposing the switch in the first operating condition. Thus, in accordance with design strategy, the first and second operating conditions of the switch should occur sequentially, even when it is necessary to return to one of the operating conditions of the switch. Because of its sequential operation, this type of electrical switch generally is referred to as a "push-to-lock; push-to-release" switch.

However, in practice, it may be found that the described electrical switch is not always disposable in the first and second operating conditions sequentially. While the plunger is travelling fully into the housing and while returning therefrom, the pawl carried on the plunger is freely rotatable in either the aforesaid predetermined direction or in the reverse direction. Consequently, during these intervals of operation, the pawl may spin backward in said reverse direction and be improperly oriented for producing the expected sequential operating condition of the switch. As a result, the switch will not be disposed in the correct operating condition for obtaining a desired electrical result from connecting electrical circuitry.

SUMMARY OF THE INVENTION

Accordingly, these and other disadvantages of the prior art are overcome by this invention providing an electrical switch having a pawl-regulated actuator with resilient tensioning means for resisting free movement of the pawl and permitting controlled movement of the pawl in a predetermined direction. The resilient tensioning means also may comprise latching means for preventing movement of the pawl in a direction opposite to the predetermined direction.

The electrical switch includes a housing having therein a plurality of switch contact members and an actuator having a shaft driven plunger disposed for reciprocal movement within the housing to operate the switch. The actuator plunger is provided with a generally planar surface whereon a pawl is mounted for rotation in a plane adjacent said planar surface. The pawl has cam surface means disposed for engagement with projections in the housing to cause rotation of the pawl relative to the planar surface of the actuator body. Thus, during rotation of the pawl, each discrete portion of the pawl travels along an arcuate path which may be projected onto the adjacent planar surface of the actuator body.

The tensioning means comprises a pair of resilient arms having proximal end portions attached to respective opposing portions of the pawl and having distal end portions disposed in pressure engagement with the adjacent planar surface of the actuator body. Each of the resilient arms may extend arcuately backward from the attached portion of the pawl and be curved in conformity with the arcuate path followed by said attached portion when the pawl is rotated. Also, each of the resilient arms may be disposed at respective uniform angles or may be bowed relative to the adjacent planar surface of the actuator body portion. As a result, the resilient arms having their distal end portions disposed in pressure engagement with said adjacent planar surface exert on the attached portions of the pawl respective tensile forces which substantially balance one another. These balanced tensile forces serve to resist free rotational movement of the pawl and to permit controlled rotational movement of the pawl in a predetermined uniform direction.

The latching means includes ratchet means comprising a ramp-like boss projecting from the otherwise planar surface of the actuator body portion and into the arcuate path traced by a distal end portion of a resilient arm. The ramp-like boss is disposed so that the distal end of an approaching resilient arm rides up the sloped surface of the ramp-like boss and drops down into abutting relationship with the sheer end surface of the ramp-like boss, similar to the action of a ratchet, for example. Thus, any tendency of the pawl to rotate in the reverse direction is prevented by the distal end of the resilient arm butting against the sheer end surface of the ramp-like boss.

BRIEF DESCRIPTION OF THE DRAWINGS

For a better understanding of this invention, reference is made in the following detailed description to the drawings wherein.

DESCRIPTION OF THE PREFERRED EMBODIMENT

Figure 1:
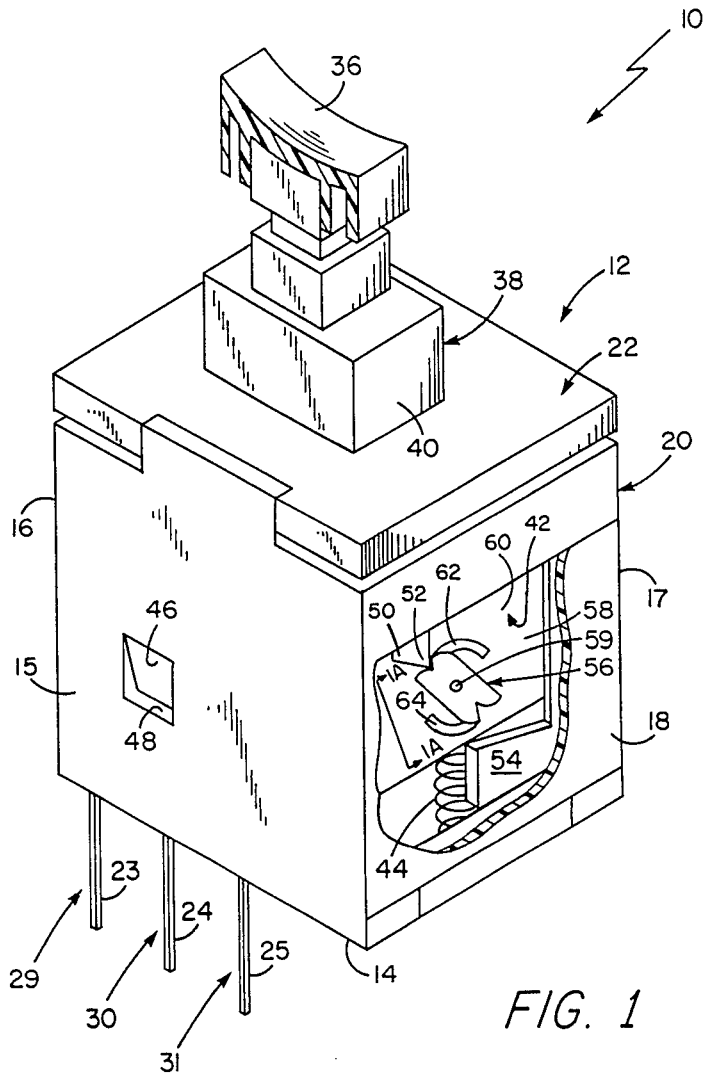
FIG. 1 is an isometric view, partly in section, of an electrical switch embodying the invention.

Referring to the drawings wherein like characters of reference designate like parts, there is shown in FIG. 1 a control device comprising an electrical switch 10 of the pushbutton type. Switch 10 includes a rigid housing 12 forming a hollow cubical enclosure and made of dielectric material, such as molded thermoplastic material, for example. The housing 12 has a bottom end wall 14 joined to four orthogonal side walls 15, 16, 17 and 18, respectively, to provide an integral box 20 having an open end which is closed by a cover 22. Extending insulatingly through the bottom wall 14 from the interior of housing 12 is a plurality of electrically conductive terminals, such as 23, 24 and 25 comprising integral end portions of respective switch contact members 29, 30 and 31, for example.

Protruding externally of housing 12 from cover 22 is an actuator means including a rigid plunger 38 made of dielectric material, such as molded thermoplastic material, for example. Plunger 38 comprises a shaft 40 which extends slidably through the cover 22 from the interior of housing 12 and terminates externally thereof in a pushbutton 36. The pushbutton 36 is mounted, as by press-fitting, for example, on a distal end portion of shaft 40 and may be made of suitable dielectric material, such as molded plastic material, for example. Thus, pushbutton 36 provides means for applying an axially directed pressure, such as a finger-pressure, for example, to the shaft 40 for sliding the shaft 40 of plunger 38 into the housing 12.

Within housing 12, the shaft 40 has a proximal end portion integrally joined to a plunger body 42 which is slidably disposed for linear reciprocal movement between the cover 22 and the bottom wall 14 of housing 12. Disposed between the bottom wall 14 and the adjacent end portion of plunger body 42 is a coil spring 44 which exerts a resilient biasing pressure on the plunger body 42 to urge it toward the cover 22 of housing 12. Thus, when the axially directed pressure on pushbutton 36 slides the shaft 40 of plunger 38 into housing 12, the plunger body 42 slides linearly toward bottom wall 14 and compresses the coil spring 44. When the axially directed pressure is removed from pushbutton 36, the coil spring 44 exerts an opposing axially directed pressure on plunger body 42 to slide it toward the cover 22. As a result, the plunger 38 tends to return to a position of maximum extension of the shaft 40 from housing 12.

The plunger body 42 is retained within housing 12 by cover 22 which is provided with fastening means including a flexible leg 46 extending integrally from the cover 22 and into housing 12. When the cover 22 is installed over the open end of box 20, the distal end portion of flexible leg 46 slides along the inner surface of side wall 15 and snaps into a port 48 suitably located in the side wall 15. Also, extending integrally from cover 22 and into housing 12 along the juncture of respective side walls 15 and 18 is a rigid leg 50. The leg 50 terminates at a predetermined distance from cover 22 in a sharp-cornered projection 52 which is formed by a sloped distal end surface of leg 50 meeting a rectilinear inner side surface thereof at an acute angle.

Diagonally of side wall 18 from the sharp-cornered projection 52, another sharp-cornered projection 54 is molded integrally in a corner portion of housing 12 formed by the juncture of bottom end wall 14 with respective side walls 17 and 18. The projection 54 has a sloped side surface extending inwardly along side wall 18 from the direction of side wall 17 to meet at an acute angle with a rectilinear side surface of projection 54 extending upwardly along side wall 18 from the direction of bottom end wall 14. Thus, the respective sharp-cornered projections 52 and 54 are disposed diagonally opposite one another in a plane adjacent and substantially parallel with the side wall 18 of housing 12. Also, disposed for rotation in the plane of the sharp-cornered projections 52 and 54 is a wafer-like hub 56 of an oblong pawl 58 made of resilient dielectric material, such as molded plastic material, for example.

The hub 56 is rotatably mounted on an axle pin 59 projecting orthogonally from a generally planar surface 60 of the reciprocally movable plunger body 42. Surface 60 is disposed in close spaced and substantially parallel relationship with the plane of sharp-cornered projections 52 and 54. Opposing end portions of the hub 56 are provided with respective contoured surface means for engaging the projections 52 and 54 in a manner to be described. As a result, the linear reciprocal movement of plunger body 42 is converted into rotational movement of the pawl 58 in a uniform direction, such as counterclockwise as viewed in FIG. 1, for example. This unidirectional rotation of pawl 58 ensures that the pawl 58 will be properly oriented when engaging the sharp-cornered projections 52 and 54 for disposing the switch 10 in different operating conditions sequentially.

Figure 1A:
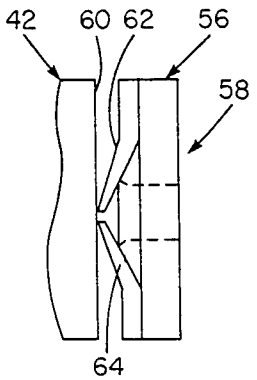
FIG. 1A is an elevational fragmentary view taken along line 1A—1A in FIG. 1 and looking in the direction of the arrows to show pressure engagement of the pawl with the adjacent surface of the plunger shown in FIG. 1.
Figure 1B:
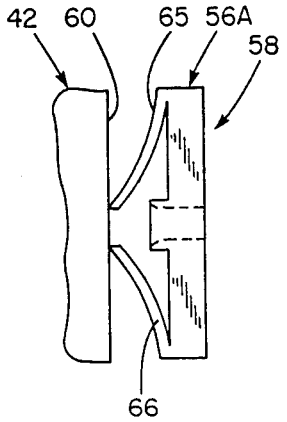
FIG. 1B is an elevational fragmentary view similar to the view in FIG. 1A but showing pressure engagement of first alternative resilient arms with the adjacent surface of the plunger shown in FIG. 1.
Figure 1C:
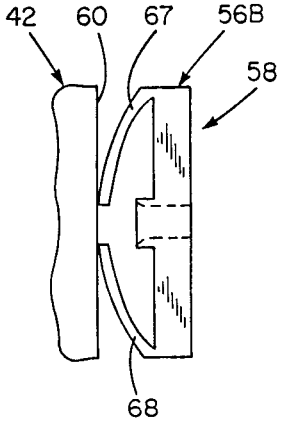
FIG. 1C is an elevational fragmentary view similar to the view in FIG. 1A but showing pressure engagement of second alternative resilient arms with the adjacent surface of the plunger shown in FIG. 1.

Accordingly, the pawl 58 is provided with tension holding means comprising at least one pair of resilient arms, 62 and 64, respectively, extending integrally from respective opposing edge portions of the hub 56. The arms 62 and 64 have proximal end portions integrally attached to respective diagonally opposing corner portions of the hub 56 and extend arcuately therefrom along the rotational paths followed by the attached corner portions of hub 56 during unidirectional rotation of the pawl 58. Also, as shown in FIG. 1A, the resilient arms 62 and 64 have respective distal end portions disposed in pressure engagement with the planar surface 60 of plunger body 42, and may extend at respective uniform angles relative to the planar surface 60. Alternatively, the resilient arms 62 and 64 may be bowed relative to planar surface 60. A first alternative embodiment, as shown in FIG. 1B, may comprise the pawl 58 provided with a hub 56a similar to hub 56 but having extended integrally from opposing portions thereof respective resilient arm 65 and 66 which are bowed concavely relative to planar surface 60. A second alternative embodiment as shown in FIG. 1C, may comprise the pawl 58 provided with a hub 56B similar to hub 56 but having extended integrally from opposing portions thereof respective resilient arm 67 and 68 which are bowed convexly relative to planar surface 60.

Thus, the distal end portions of arms 62 and 64 pressing against the planar surface 60 develop respective resilient pressures which are transmitted through the arms 62 and 64 to their proximal end portions. As a result, the arms 62 and 64 exert on the attached portions of hub 56 respective tensile forces which are substantially balanced due to the arms 62 and 64 being integrally attached to opposing portions of the hub 56. With the balanced tensile forces exerted on opposing portions of hub 56, the pawl 58 is enabled to resist free or uncontrolled rotational movement of the pawl in either the clockwise or the counterclockwise direction. Consequently, when the pawl 58 is at rest it is maintained at an orientation suitable for proper engagement with the projections 52 and 54 to provide unidirectional rotation of the pawl 58. Furthermore, when the pawl 58 is undergoing unidirectional rotation, the distal end portions of arms 62 and 64 provide a brushing frictional engagement with the planar surface 60 along respective arcuate paths followed by the integrally attached corner portions of hub 56. Accordingly, the resilient arms 62 and 64 interact with the surface 10 to provide a slight braking means for steadying rotational movement of the pawl 58 and smoothing any erratic motion while the pawl 58 is undergoing unidirectional rotation.

Figure 2E:
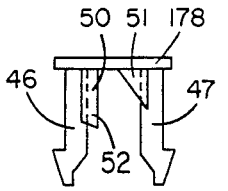
FIG. 2E is an elevational view of the cover taken along the line 2E—2E in FIG. 2 and looking in the direction of the arrows.
Figure 2B:
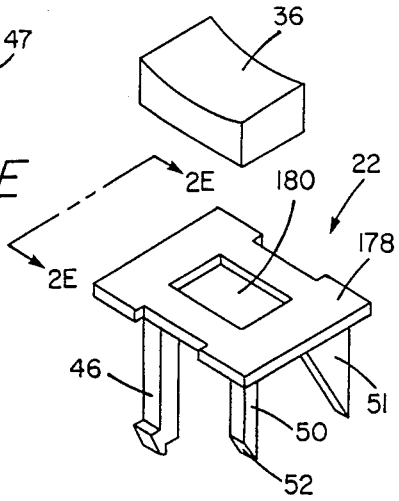
FIG. 2B is an elevational fragmentary view of the plunger taken along the line 2B—2B in FIG. 2 and looking in the direction of the arrows.
Figure 2B:
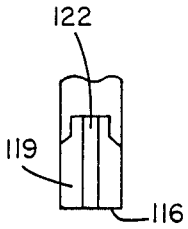
Figure 2C:
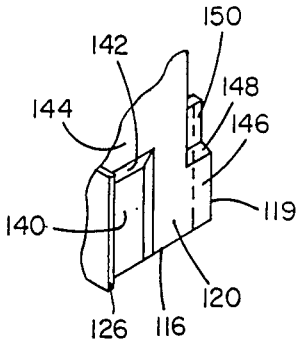
FIG. 2C is an elevational fragmentary view of the plunger taken along the line 2C—2C in FIG. 2 and looking in the direction of the arrows.
Figure 2D:
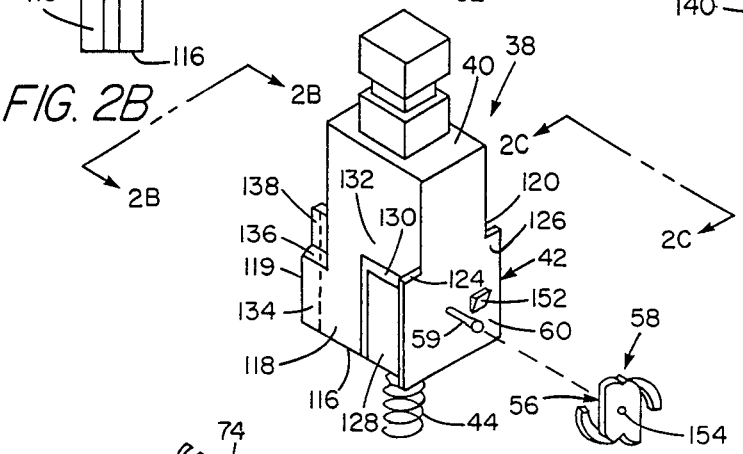
FIG. 2D is an enlarged isometric view of the pawl shown in FIG. 2.
Figure 2D:
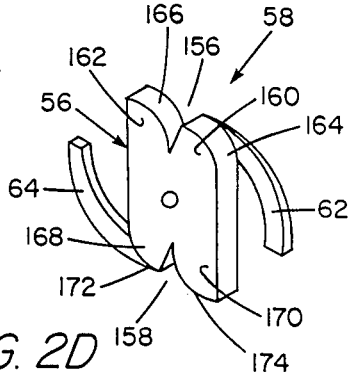
Figure 2:
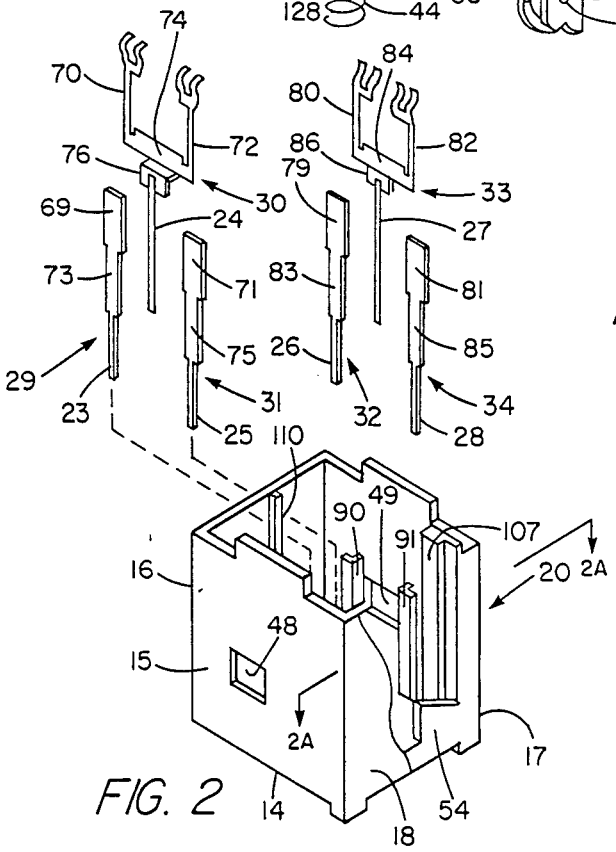
FIG. 2 is an exploded isometric view of the assembled switch shown in FIG. 1.

As shown in FIG. 2, the switch contact members 29, 30 and 31 are disposed for installation within the open-ended box 20 and adjacent the inner surface of side wall 15. The switch contact members 29 and 31 have inner end portions comprising rigid stationary contacts 69 and 71, respectively, which are integrally connected through intermediate portions, 73 and 75, respectively, to the externally extending terminals, 23 and 25, respectively. Switch contact member 30 has an inner end portion of generally U-shaped configuration comprising a pair of resiliently movable contact arms 70 and 72 having respective proximal end portions integrally connected to respective opposing end portions of a cross piece 74. The cross piece 74 has a mid-portion electrically connected through an angle bracket 76 to the terminal 24. When installed in open-ended box 20, the movable contact arms 70 and 72 are disposed in operative alignment with the stationary contacts 69 and 71, respectively, but are spaced therefrom by angle bracket 76.

Disposed for installation within open-ended box 20 and adjacent the inner surface of side wall 17 are switch contact members 32, 33 and 34, respectively, which are similar to switch contact members 29, 30 and 31, respectively. Thus, the switch contact members 32 and 34 have inner end portions comprising rigid stationary contacts, 79 and 81, respectively, which are integrally connected through intermediate portions, 83 and 85, respectively, to externally extending terminals 26 and 28, respectively. Switch contact member 33 has an inner end portion of generally U-shaped configuration comprising a pair of resiliently movable contact arms 80 and 82, respectively, having respective proximal end portions integrally connected to respective opposing end portions of a cross-piece 84. The cross-piece 84 has a mid-portion electrically connected through an angle bracket 86 to an externally extending terminal 27. When installed in the open-ended box 20, the movable contact arms 80 and 82 are disposed in operative alignment with the stationary contacts 79 and 81, respectively, but are spaced therefrom by angle bracket 86.

Figure 2A:
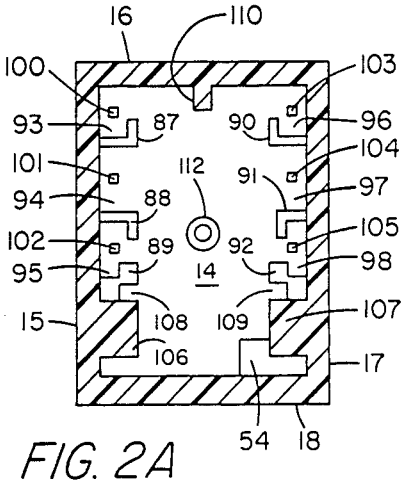
FIG. 2A is a cross-sectional view of the open-ended box taken along the line 2A—2A in FIG. 2 and looking in the direction of the arrows.

Extending through the side wall 17 of box 20 is a port 49 which is substantially aligned with the port 48 in side wall 15 and serves a similar purpose. As shown more clearly in FIG. 2A, side wall 15 has protruding integrally from its inner surface respective right-angled ribs 87, 88 and 89 which are mutually spaced apart and substantially parallel with one another. Also, side wall 17 has protruding integrally from its inner surface respective right-angled ribs 90, 91 and 92 which are mutually spaced apart and substantially parallel with one another. The ribs 87–92 extend rectilinearly from the bottom wall 14 and terminate substantially equal distances below the rim of open-ended box 20. Thus, the ribs 87–89 form adjacent the inner surface of side wall 15 respective laterally aligned slots 93, 94 and 95 which have open ends directed toward the rim of box 20 and opposing closed ends provided with central through-holes 100, 101 and 102, respectively. Moreover, the ribs 90–92 form adjacent the inner surface of side wall 17 respective laterally aligned slots 96, 97 and 98 which have open ends directed toward the open end of box 20 and opposing closed ends provided with central through-holes 103, 104 and 105, respectively.

In assembly, the switch contact members 29 and 31 are installed in box 20 by inserting their terminals 23 and 25 through the respective holes 100 and 102, and pressing their intermediate portions 73 and 75 into the respective slots 93 and 95 until their rigid contacts 69 and 71 abut the open ends of slots 93 and 95, respectively. As a result, the rigid contacts 69 and 71 of switch contact members 29 and 31, respectively, extend along respective inner surface portions of side wall 15 from the open ends of slots 93 and 95, respectively, to terminate just below the rim of box 20. Also, the switch contact members 32 and 34 are installed in box 20 by inserting their terminals 26 and 28 through the respective holes 103 and 105, and pressing their intermediate portions 83 and 85 into the respective slots 96 and 98 until their rigid contacts 79 and 81 abut the open ends of slots 96 and 98, respectively. As a result, the rigid contacts 79 and 81 of switch contact members 26 and 28, respectively, extend along respective inner surface portions of side wall 17 from the open ends of slots 96 and 98, respectively, to terminate just below the rim of box 20.

The switch contact member 30 is installed in box 20 by inserting the terminal 24 through the hole 101 and pressing the bracket 76 into slot 94 until it touches the bottom wall 14. As a result, the bracket 76 supports the cross piece 74 below the port 48 and in sufficient spaced relationship with the inner surface of wall 15 for the cross piece 74 to extend beyond the ribs 87 and 88, respectively. Consequently, the movable contact arms 70 and 72 attached to respective opposing end portions of the cross piece 74 are disposed in spaced alignment with the switch contact members 29 and 31, respectively. Similarly, the switch contact member 33 is installed in box 20 by inserting the terminal 26 through the hole 104 and pressing the bracket 86 into slot 97 until it touches the bottom wall 14. As a result, the bracket 86 supports the cross piece 84 below the port 49 and in sufficient spaced relationship with the inner surface of wall 17 for the cross piece 84 to extend beyond the ribs 90 and 91, respectively. Consequently, the movable contact arms 80 and 82 attached to respective opposing end portions of the cross piece 84 are disposed in spaced alignment with the switch contact members, 32 and 34, respectively.

Adjacent the ribs 89 and 92, respective heavier ribs 106 and 107 protrude integrally from the inner surfaces of side walls 15 and 17, respectively, and extend from the bottom wall 14 to the rim of box 20. The inner surfaces of ribs 89 and 92 have disposed in elevational marginal portions thereof two sides of respective U-shaped grooves 108 and 109 which have their third sides provided by the adjacent heavier ribs 106 and 109, respectively. The grooves 108 and 109 extend from the bottom wall 14 to the end surfaces of ribs 89 and 92, respectively. Disposed between the rib 109 and the side wall 18 is the integral sharp-cornered projection 54. The side wall 16 has protruding elevationally from a central portion of its inner surface an integral guide rib 110 which extends from the bottom wall 14 to the rim of box 20. Also, the inner surface of bottom wall 14 has centrally disposed therein a circular recess 112 which receives the adjacent end portion of coil spring 44.

Referring again to FIG. 2, the coil spring 44 has an opposing end portion which may be fitted into a circular recess (not shown) similar to the circular recess 112 but disposed in an adjacent bottom surface 116 of the plunger body 42. When the plunger body 42 is installed in box 20, respective side surfaces 118, 119 and 120 of the body 42 are disposed adjacent the side walls 15, 16 and 17, respectively, of box 20. As shown more clearly in FIG. 2B, there is elevationally disposed in a central portion of the side surface 119 a groove 122 which extends from the bottom surface 116 of plunger body 42 to the proximal end portion of shaft 40. The groove 122 slidably receives therein the guide rib 110 when the plunger body 42 is inserted into box 20. Extending orthogonally outward from elevational marginal portions of the side surfaces 118 and 120 adjacent the planar surface 60 are respective thin rectangular projections or runners 124 and 126, The runners 124 and 126 extend from the bottom surface 116 of plunger body 42 to the proximal end portion of shaft 40 and are slidably inserted into the respective grooves 108 and 109 when the plunger body 42 is installed in box 20. Thus, the plunger body 42 is slidably supported within box 20 for linear reciprocal movement between the bottom wall 14 and the rim of box 20.

Disposed in an elevational portion of side surface 118 adjacent runner 124 and along the direction of linear reciprocal movement of plunger body 42 there is a recessed area 128 which extends from the bottom surface 116 to a sloped cam area 130 leading to a raised landing area 132 of surface 118. Also, there is disposed in an elevational portion of side surface 118 adjacent the side surface 119 and along the direction of linear reciprocal movement of plunger body 42 a raised landing area 134 which extends from the bottom surface 116 to a sloped cam area 136 leading to a recessed area 138 of surface 118. When the plunger body 42 is installed in the box 20, the recessed area 128, the sloped cam area 130 and the landing area 132 are disposed in operative alignment with the movable contact arm 72 of switch contact member 30. Furthermore, the landing area 134, the sloped cam area 136 and the recessed area 138 are disposed in operative alignment with the movable contact arm 70 of switch contact member 30 when the plunger body 42 is installed in the box 20.

As shown more clearly in FIG. 2C, there is disposed in an elevational portion of side surface 120 adjacent runner 126 and along the direction of linear reciprocal movement of plunger body 42 a recessed area 140 which extends from the bottom surface 116 to a sloped cam area 142 leading to a raised landing area 144. Moreover, there is disposed in an elevational portion of side surface 120 and along the direction of linear reciprocal movement of plunger body 42 a raised landing area 146 which extends from the bottom surface 116 to a sloped cam area 148 leading to a recessed area 150 of surface 120. When the plunger body 42 is installed in box 20, the recessed area 140, the sloped cam area 142 and the landing area 144 are disposed in operative alignment with the movable contact arm 82 of switch contact member 33. Furthermore, the landing area 146, the sloped cam area 148 and the recessed area 150 are disposed in operative alignment with the movable contact arm 80 of switch contact member 33 when the plunger body 42 is installed in box 20.

The planar surface 60 extends from the bottom surface 116 of plunger body 42 to the adjacent end portion of the shaft 40 and may include, as lateral extensions of surface 60, adjacent surface portions of the runners 124 and 126, respectively. Also, the planar surface 60 may be provided with a ramp-like boss 152 having a sloped surface disposed in the rotational path of the resilient arms 62 and 64, respectively, of pawl 58 for engagement therewith. Projecting orthogonally from a central portion of the planar surface 60 is the axle pin 59 which may be molded as an integral part of the dielectric plunger 38 and have a slightly enlarged distal end portion for retaining purposes. Alternatively, the axle pin 59 may comprise a metal pin (not shown) having a proximal end portion fixedly embedded, as by molding, for example, in the dielectric material of plunger 38 and having an opposing mushroomed or header end portion. The hub 56 of pawl 58 has a central portion provided with a through-aperture 154 of suitable size for snap-fitting over a slightly enlarged distal end portion of axle pin 59 and being retained rotatably on the remaining portion thereof protruding from surface 60. As a result, the pawl 58 is mounted for rotation adjacent the surface 60 and in the plane of sharp-cornered projections 52 and 54 for engagement therewith.

As shown more clearly in FIG. 2D, the wafer-like hub 56 of oblong pawl 58 has opposing end portions wherein there is centrally disposed respective notches 156 and 158, each of which has a generally V-shaped configuration. The notch 156 is disposed between two saw-like teeth 160 and 162, respectively. which have abrupt or generally straight leading edges and convexly curved trailing edges which comprise respective cam edges 164 and 166 of the pawl 58. Similarly, the notch 158 is disposed between two saw-like teeth 168 and 170, respectively, which have abrupt or generally straight leading edges and convexly curved trailing edges which comprise respective cam edges 172 and 174 of the pawl 58.

The resilient arm 62 extends integrally from the surface of tooth 160 adjacent the surface 60 when the pawl 58 is mounted for rotation on the axle pin 59, and may extend at a uniform angle or may be bowed with respect to the surface 60 as described. Also, the resilient arm 64 extends integrally from the surface of tooth 168 adjacent the surface 60 when the pawl 58 is mounted for rotation on the axle pin 59, and may extend at a uniform angle or may be bowed with respect to the surface 60 as described. Moreover, the resilient arms 62 and 64 extend arcuately along respective paths followed by the teeth 160 and 168 when the pawl 58 is rotated in the counter-clockwise direction as viewed in FIG. 1. As a result, the distal end portions of arms 62 and 64 frictional engage the surface 60 and follow thereon the rotational paths of the teeth 160 and 168, respectively, during said counterclockwise rotation. Consequently, since the ramp-like like boss 152 is disposed in the rotational paths of the respective arms 62 and 64, the distal end portions of one of the resilient arms 62 and 64 will ride up the sloped surface of boss 152 and snap resiliently down into abutting relationship with the sheer surface of boss 152 in a rachet-type action. Thus, the ramp-like boss 152 provides latching means for ensuring that the pawl 58 will not rotate in the reverse or clockwise direction as viewed in FIG. 1.

Referring again to FIG. 2, the cover 22 may comprise a generally flat plate 178 having a peripheral configuration suitable for fitting onto the rim of box 20. Centrally disposed in the plate 178 is a through-aperture 180 sized for slidably receiving therein the shaft 40 of plunger 38 protruding from the box 20. As shown more clearly in FIG. 2E, the surface of plate 178 to be disposed on the rim of box 20 has protruding integrally from portions thereof adjacent one end of aperture 180 the fastening means including flexible leg 46 and a laterally aligned, flexible leg 47. The legs 46 and 47 are disposed on opposing sides of the aperture 180 adjacent the respective side walls 15 and 17 of box 20. Furthermore, the surface of plate 178 to be disposed on the rim of box 20 has protruding integrally from portions thereof adjacent the opposing end of aperture 180 the rigid leg 50 and a laterally aligned, triangular leg 51 which provides structural rigidity.

Consequently, when the plate 178 is passed slidably over the shaft 40 of plunger 38, the distal end portion of flexible legs 46 and 47 extend into slidable engagement with the inner surfaces of side walls 15 and 17, respectively. Simultaneously, the rigid leg 50 extends into a corner portion of box 20 defined by the orthogonal side walls 15 and 18, respectively; and the rigid triangular leg 51 extends into the laterally aligned, corner portion of box 20 defined by side walls 17 and 18, respectively. Thus, when the plate 178 of cover 22 seats on the rim of box 20, the distal end portions of flexible legs 46 and 47 snap resiliently into the respective ports 48 and 49 to fasten the cover 22 securely in place. Moreover, the rigid leg 50 is disposed in the corner defined by side walls 15 and 18, respectively, such that sharp-cornered projection 52 provided by the leg 50 is disposed in the plane of pawl 58 for engagement therewith. After the cover 22 is installed, as described, the pushbutton 36 is pressed onto the distal end portion of shaft 40 extending slidably through the aperture 180 in cover 22.

Figure 3B:
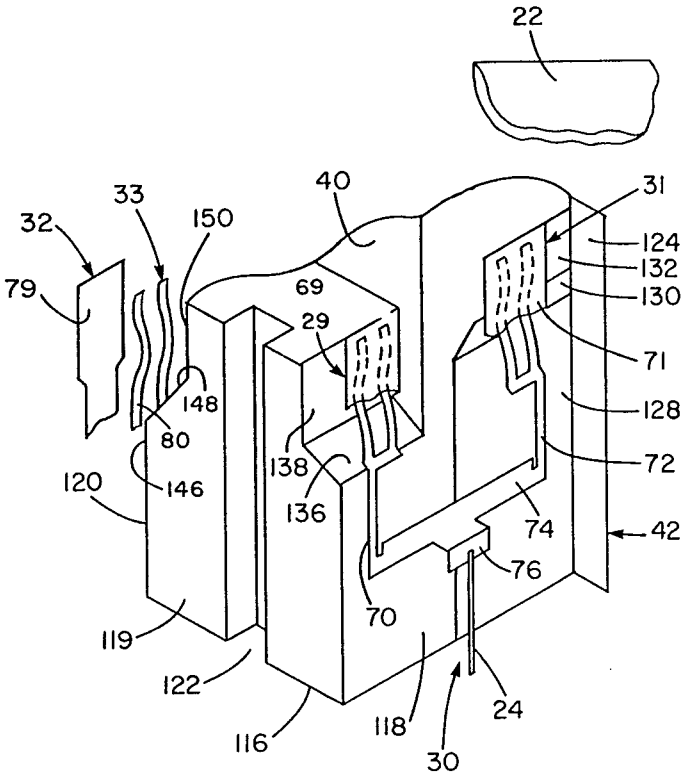
FIG. 3B is an isometric fragementary schematic view of another operating condition of the switch shown in FIG. 1.
Figure 3A:
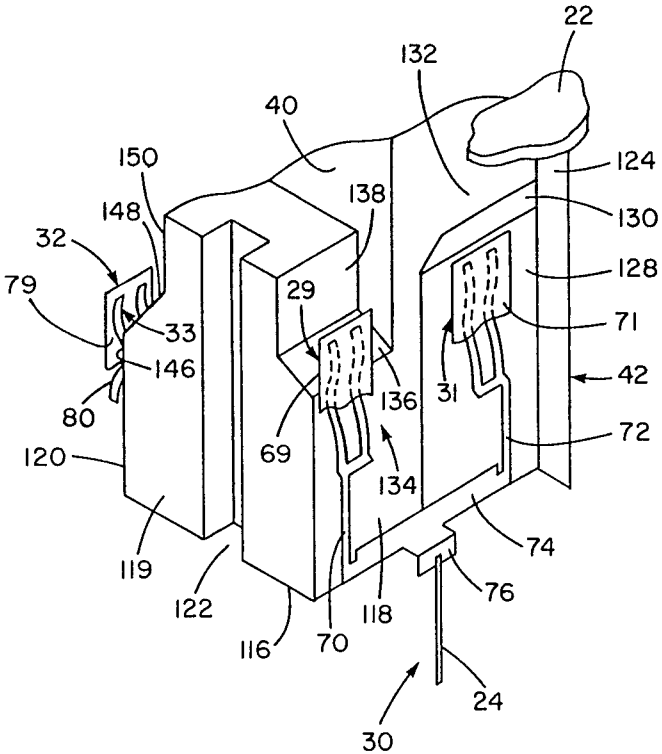
FIG. 3A is an isometric fragmentary schematic view of one operating condition of the switch shown in FIG. 1.

In operation, the assembled switch 10 shown in FIG. 1 may be disposed in a first operating condition where the shaft 40 extends a maximum distance from housing 12 and, as shown in FIG. 3A, the plunger body 42 abuts the inner surface of cover 22. Therefore, the landing areas 134 and 146 of plunger body surfaces 118 and 120, respectively, pressingly engage the distal end portions of contact arms 70 and 80, respectively. Consequently, the distal end portions of contact arms 70 and 80 are pressed resiliently into electrical engagement with the stationary contacts 69 and 79 of contact members 29 and 32, respectively.

Simultaneously, the recessed area 128 of plunger body surface 118 is disposed in alignment with the distal end portion of contact arm 72. Also, although not shown in FIG. 3A, the recessed area 140 (FIG. 2C) of plunger body surface 120 is disposed in alignment with the distal end portion of contact arm 82 (FIG. 2). As a result, the distal end portions of contact arms 72 and 82 are not pressed into electrical engagement with the stationary contacts 71 and 81 of contact members 31 and 34, respectively. Thus, in the first operating condition of switch 10, the contact members 30 and 33 are electrically connected to the contact members 29 and 32, respectively.

In actuating the assembled switch 10 shown in FIG. 1, an axially directed pressure is applied to the pushbutton 36 for moving the plunger 38 linearly into housing 12 to the limit of its travel. Consequently, as shown by comparing FIG. 3A with FIG. 3B, the distal end portions of contact arms 70 and 80 ride down the sloped cam areas 136 and 148, respectively, and onto the recessed areas 138 and 150 of plunger body surfaces 118 and 120, respectively. As a result, the distal end portions of contact arms 70 and 80 move resiliently out of electrical engagement with the stationary contacts 69 and 79, respectively. Thus, the contact members 30 and 33 are disconnected electrically from the contact members 29 and 32, respectively.

Subsequently, the distal end portion of contact arm 72 rides up the sloped cam area 130 and into pressure engagement with the landing area 132 of plunger body surface 118. Also, although not shown in FIG. 3B, the distal end portion of contact arm 82 (FIG. 2) rides up the sloped cam area 142 (FIG. 2C) and into pressure engagement with the landing area 144 of plunger body surface 120. Consequently, the distal end portions of contact arms 72 and 82 are pressed into electrical engagement with the stationary contacts 79 and 81 of contact members 32 and 34, respectively.

The pressure applied to the pushbutton 36 of switch 10 shown in FIG. 1 is then removed to permit the coil spring 44 to slide the plunger body 42 linearly toward the cover 22. However, when the shaft 40 is extended only partially or less than the maximum distance from housing 12, the plunger 38 is locked in a position where the plunger body 42 is still spaced from the cover 22, as shown in FIG. 3B. In this second operating condition of switch 10, the recessed areas 138 and 150 remain in alignment with the distal end portions of contact arms 70 and 80, respectively, to permit them to remain out of electrical engagement with the stationary contacts 69 and 79 of contact members 29 and 32, respectively. Also, the landing areas 132 and 144 remain in pressure engagement with the distal end portions of contact arms 72 and 82 to hold them resiliently in electrical engagement with the stationary contacts 79 and 81 of contact members 31 and 34, respectively. Thus, in this sequential second operating condition of switch 10, the contact members 30 and 33 are electrically connected to the contact members 31 and 34 (FIG. 2), respectively.

When an axially directed pressure is again applied to the pushbutton 36 of switch 10 shown in FIG. 1 and removed, the plunger body 42 slides linearly toward the bottom wall 14 of housing 12 and is moved reciprocally by the coil spring 44 into abutting relationship with the inner surface of cover 22. As a result, the switch 10 returns to the first operating condition shown in FIG. 3A. Successive actuations of the switch 10, as described, cause it to change sequentially from the first operating condition shown in FIG. 3A to the second operating condition shown in FIG. 3B and then back again to the first operating condition shown in FIG. 3A. Thus, the switch 10 functions as a double pole-double throw switch. Alternatively, either the contact member 30 or the contact member 33 may be omitted to convert the switch 10 to a single pole-double throw type of electrical switch. As a further alternative, with only the contact member 30 installed, for example, either the contact member 29 or the contact member 31 may be omitted to convert the switch 10 to a single pole-single throw type of electrical switch.

Figure 4A:
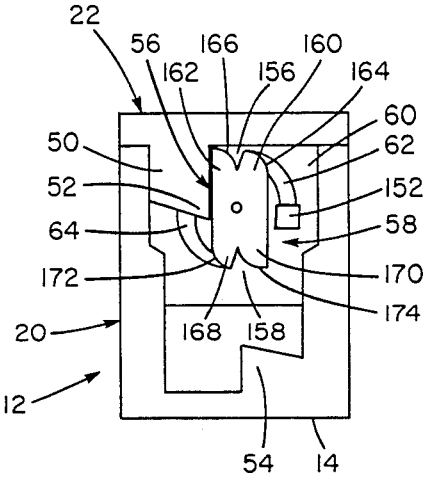
FIGS. 4A—4F are respective elevational schematic views showing movement of the pawl during actuation of the switch shown in FIG. 1 to obtain the respective operating conditions shown in FIGS. 3A and 3B sequentially.

When the switch 10 shown in FIG. 1 is disposed in the first operating condition shown in FIG. 3A, the oblong pawl 58, as shown in FIG. 4A, has rotated into juxtaposed relationship with the rigid leg 50, which depends from cover 22 in spaced relationship with planar surface 60. Also, the arm 64 has passed resiliently between the rigid leg 50 and the planar surface 60 while maintaining its distal end portion in pressure engagement with the planar surface 60. Moreover, the distal end portion of arm 62 pressingly engaging the planar surface 60 has travelled up the sloped surface of ramp-like boss 152 and snapped resiliently off the sheer end thereof in a ratchet-like action. As a result, the distal end of arm 62 is disposed in abutting relationship with the sheer end surface of ramp-like boss 152. Thus, the arm 62 and the ramp-like boss 152 constitute a positive stop latching means for preventing the oblong pawl 58 from rotating in the reverse or clockwise direction, as viewed in FIG. 4A.

Figure 4B:
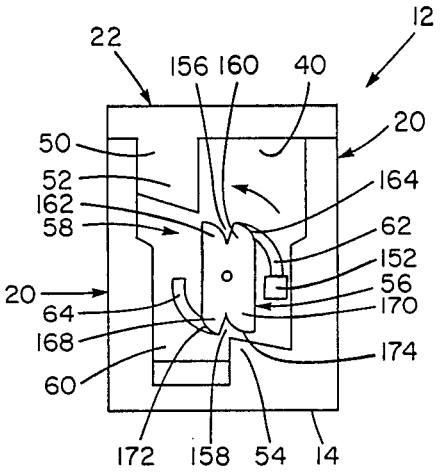

When the switch 10 is actuated, as described, the plunger body 42 slides linearly toward the bottom wall 14 of housing 12 and, as shown in FIG. 4B, carries the rotatable pawl 58 away from the orientating influence provided by rigid leg 50. During this interval of actuation, the pawl 58 is restricted from rotating in the clockwise direction by the ramp-like boss 152 but, if not restrained, could undergo an unintended rotation in the counterclockwise direction. Accordingly, in the switch 10, a pawl restraining means is provided by the resilient arms 62 and 64 extending integrally from the diagonally opposing portions of hub 56 and having their respective distal end portions pressing resiliently against the planar surface 60. As a result, the resilient arms 62 and 64 exert on the diagonally opposing portions of hub 56 respective balanced tensile forces which enable the pawl 58 to resist free rotation in either the clockwise or the counterclockwise directions. Consequently, the pawl 58 is maintained at the proper orientation for interference engagement with the sharp corners of projections 52 and 54, respectively.

Figure 4C:
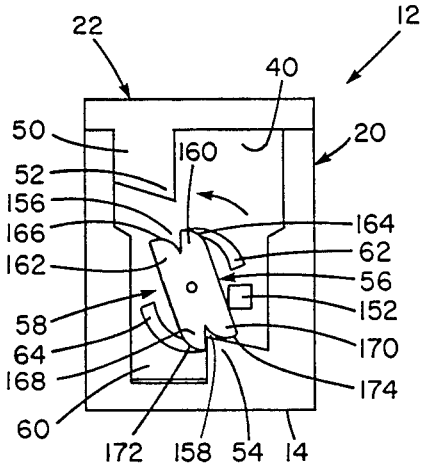

As shown in FIG. 4C, when the plunger body 42 approaches the bottom wall 14 of housing 12, the sharp corner of projection 54 enters the notch 158 disposed between the saw-like teeth 168 and 170, respectively. Thus, with the pawl 58 at the proper orientation, the curved cam edge 174 of tooth 170 is brought into pressure engagement with the sloped edge of projection 54 to cause a predetermined rotation of the pawl 58 in the counterclockwise direction. Thus, it may be seen that the tensile forces exerted by resilient arms 62 and 64 on the attached portions of hub 56 are sufficient for enabling the pawl 58 to resist free rotation, but are insufficient to prevent controlled rotation of pawl 58. However, during the controlled rotaton of pawl 58, the frictional engagement of the distal end portions of arms 62 and 64 provides a slight dragging or braking action which serves to smooth rotational movement and minimize any erratic movements of the pawl 58. Also, it should be noted that the controlled rotation of pawl 58 in the counterclockwise direction moves the distal end of resilient arm 62 away from butting engagement with the sheer end surface of ramp-like boss 152.

Figure 4D:
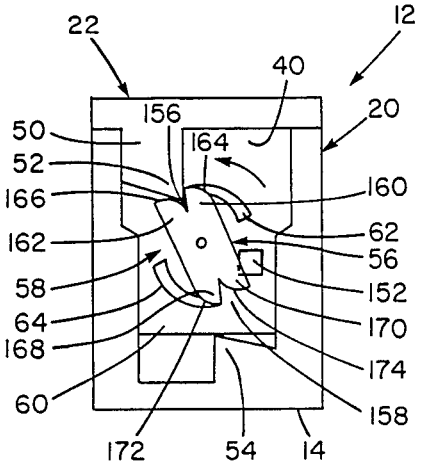

When the actuating pressure applied to pushbutton 36 shown in FIG. 1 is removed, the coil spring 44 slides the plunger body 42 toward the inner surface of cover 22 which, as shown in FIG. 4D, carries the pawl 58 away from the orientating influence of projection 54. During this interval of actuation, the ramp-like boss 152 is no longer restricting clockwise rotation of the pawl 58. Consequently, the resilient arms 62 and 64 with their distal end portions pressing resiliently against the planar surface 60 function as the sole restraining means for enabling the pawl 58 to resist free rotation in either the clockwise or the counterclockwise directions. Thus, the balanced tensile forces applied to opposing portions of the hub 56 by the arms 62 and 64, respectively, serve to maintain the pawl 58 at the proper orientation for interference engagement with the projection 52.

When the plunger body 42 is still spaced from the inner surface of cover 22, the sharp corner of projection 52 enters the notch 156 disposed between saw-like teeth 162 and 164, respectively, of the pawl 58. Consequently, the curved cam edge 166 of tooth 162 is brought into pressure engagement with the sloped edge of projection 52 to cause another controlled rotation of pawl 58 in the counterclockwise direction. Also, during this second controlled rotation of pawl 58, the distal end portions of resilient arms 62 and 64 being in frictional engagement with surface 60 provide a slight braking action to smooth rotation of pawl 58. This second controlled rotation of pawl 58 is terminated by the rectilinear edge of projection 52 being brought into abutting relationship with the straight edge of tooth 164 to prevent further movement of the pawl 58 and the plunger body 42. Thus, the plunger body 42 is held in predetermined spaced relationship with the inner surface of cover 22; and the switch 10 is locked in the second operating condition shown in FIG. 3B for as long as desired.

Figure 4E:
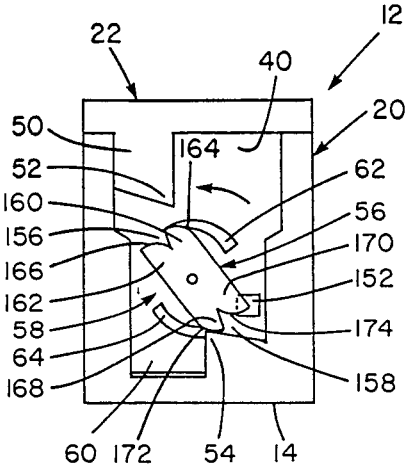

When actuating pressure again is applied to the pushbutton 36 shown in FIG. 1, the plunger body 42 slides linearly toward the bottom wall 14 of housing 12 which, as shown in FIG. 4E, carries the pawl 58 away from the orientating and locking influence of projection 52. Thus, during this interval of actuation, the arms 62 and 64 with their distal end portions pressing resiliently against the planar surface 60 function as the sole restraining means for enabling the pawl 58 to resist free rotation in either the clockwise or the counterclockwise directions. Consequently, the balanced tensile forces applied to opposing portions of the hub 56 by the arms 62 and 64, respectively, serve to maintain the pawl 58 at the proper orientation for another interference engagement with the projection 54. As a result, the curved cam edge 172 of tooth 168 is brought into pressure engagement with the sloped edge of projection 54 to cause a third controlled rotation of pawl 58 in the counterclockwise direction. During this third controlled rotation of pawl 58, the distal end portions of resilient arms 62 and 64 being in frictional engagement with surface 60 provide a slight braking action which smooths the rotational movement of pawl 58.

Figure 4F:
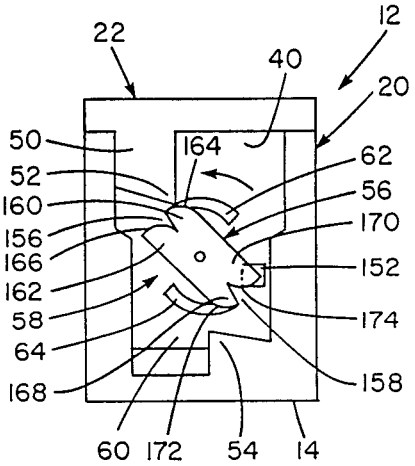

When the actuating pressure applied to pushbutton 36 shown in FIG. 1 is removed, the coil spring 44 slides the plunger body 42 linearly toward the inner surface of cover 22 which, as shown in FIG. 4F, carries the pawl 58 away from the projection 54. During this interval of actuation, the arms 62 and 64 with their distal end portions pressing resiliently against the planar surface 60 still function as the sole restraining means for enabling the pawl 58 to resist free rotation in either the clockwise or the counterclockwise directions. The resulting balanced tensile forces applied to opposing portions of the hub 56 by the arms resilient 62 and 64, respectively, serve to maintain the pawl 58 at the proper orientation for another interference engagement with the projection 52. Consequently, the curved cam surface 164 of tooth 160 is brought into pressure engagement with the sloped edge of projection 52 to cause a fourth controlled rotation of pawl 58 in the counterclockwise direction.

As a result, the pawl 58 is rotated into the orientation shown in FIG. 4A except the opposing side surface of pawl 58 is now disposed in abutting relationship with the inner side surface of rigid leg 50. Also, the arm 62 passes resiliently between the rigid leg 50 and the planar surface 60 while maintaining its distal end portion in pressure engagement with the surface 60. Moreover, the distal end portion of arm 64 rides up the sloped surface of ramp-like boss 152 and snaps resiliently off the sheer end thereof. Accordingly, the distal end of arm 64 is then disposed in butting relationship with the sheer end surface of ramp-like boss 152. As a result, the switch 10 is locked into the first operating condition shown in FIG. 3A for as long as desired. Accordingly, the entire cycle of pressing pushbutton 36 to lock the switch 10 in the second operating condition shown in FIGS. 3B and 4D, respectively, and pressing pushbutton 36 again to lock the switch 10 sequentially in the first operating condition shown in FIGS. 3A and 4A, respectively, requires that the pawl 58 be rotated uniformly in the counterclockwise direction only one-half a revolution about the axle pin 59.

Thus, there has been disclosed herein a control device having an actuator regulated by a continuously controlled pawl which is provided with restraining means for holding the pawl at predetermined orientations to produce expected operating conditions of the device. The control device includes an electrical switch having an actuator comprising a reciprocally movable plunger provided with a substantially planar surface whereon a pawl is mounted for rotation in a plane adjacent the planar surface. The rotatable pawl is provided with tensioning means comprised of resilient arms extended from opposing portions of the pawl and into resilient pressure engagement with the planar surface for exerting respective balanced tensile forces on said opposing portions of the pawl. The balanced tensile forces enable the pawl to resist free rotational movement and to permit controlled rotational movement of the pawl during actuation of the switch. Also, the tensioning means may comprise latching means including a ramp-like boss protruding from a portion of the planar surface in the rotational paths of the resilient arms. The ramp-like boss is disposed such that one of the arms rides up the sloped surface of the boss and snape resiliently off the shear end thereof to bring its distal end into abutting relationship with the sheer end surface of the ramp-like boss in a ratchet-like action. Thus, the resilient arms and the ramp-like boss comprise a positive stop latching means for preventing the pawl from rotating in a direction reverse to the desired rotational direction of the pawl.

From the foregoing, it will be apparent that all of the objectives have been achieved by the structures and methods described herein. It also will be apparent, however, that various changes may be made by those skilled in the art without departing from the spirit of the invention as expressed in the appended claims. It is to be understood, therefore, that all matter shown and described is to be interpreted as illustrative and not in a limiting sense.

What is claimed is:

1. A control device comprising:

a support member;

actuator means disposed on said support member for reciprocal movement and switching of said device between first and second operating conditions;

pawl means mounted on said actuator means for controlled movement in accordance with movement of the actuator means and determining the operating condition of the device;

and resilient tensioning means extended from the pawl means to the actuator means for permitting only said controlled movement of the pawl means.

2. A control device as set forth in claim 1 wherein said controlled movement of the pawl means comprises rotary movement relative to a surface portion of the actuator means, and said resilient tensioning means extends into engagement with said surface portion of the actuator means.

3. A control device as set forth in claim 2 wherein said resilient tensioning means extends into pressure engagement with said surface and includes braking means for smoothing said controlled rotary movement of the pawl means.

4. A control device as set forth in claim 3 wherein said resilient tensioning means comprises flexible arm means extended from opposing portions of the pawl means and into resilient pressure engagement with said surface of the actuator means for exerting respective balanced tensile forces on said opposing portions of the pawl means.

5. A control device as set forth in claim 4 wherein said resilient arm means includes latching means for preventing uncontrolled rotary movement of said pawl means.

6. A switching device comprising:

a housing;

actuator means disposed for reciprocal movement in the housing and switching said device alternatively to a first operating condition and a second operating condition;

pawl means mounted on the actuator means for controlled rotary movement in response to said reciprocal movement of the actuator means and determining the operating condition of the device; and resiliently operable restraining means disposed between the actuator means and the pawl means for maintaining the pawl means in required positions during said rotary movement of the pawl means.

7. A switching device as set forth in claim 6 wherein said actuator means includes a surface and said pawl means is mounted on said surface for controlled rotary movement relative to said surface.

8. A switching device as set forth in claim 7 wherein said resiliently operable restraining means includes resilient arm means extended from opposing portions of said pawl means and into frictional engagement with said surface of the actuator means.

9. A switching device as set forth in claim 8 wherein said resilient arm means includes a pair of flexible arms having proximal end portion attached to respective opposing portions of said pawl means and having distal end portions pressing resiliently against said surface of the actuator means.

10. A switching device as set forth in claim 6 wherein said resiliently operable restraining means includes latching means comprising a boss extended from said surface for engaging the distal end portion of one of said arms in a ratchet-like manner.

11. An electrical switch device comprising:

a housing;

actuator means including a plunger having a substantially planar surface disposed for reciprocal movement in the housing for switching said device sequentially between first and second operating conditions of the device;

pawl means mounted on said substantially planar surface for controlled rotary movement in response to said reciprocal movement and determining the operating condition of the device;

and resilient pressure means disposed between the pawl means and said substantially planar surface for resisting uncontrolled rotary movement and permitting said controlled rotary movement of the pawl means.

12. An electrical switch device as set forth in claim 11 wherein pawl means includes a wafer-like hub means mounted on said substantially planar surface for rotary movement in a plane substantially parallel with said substantially planar surface.

13. An electrical switch device as set forth in claim 11 wherein said resilient pressure means includes resilient arm means including a pair of flexible arms having proximal end portions attached to respective opposing portions of said hub means and having distal end portions disposed in resilient pressure engagement with the substantially planar surface for exerting respective balanced tensile forces on said opposing portions of the hub means.

14. An electrical switch device as set forth in claim 13 wherein said balanced tensile forces are sufficient for resisting the uncontrolled rotary movement of said pawl means and are insufficient for preventing the controlled rotary movement of said pawl means.

15. An electrical switch device as set forth in claim 14 wherein said flexible arms include intermediate portions which are bowed relative to the substantially planar surface.

16. An electrical switch device as set forth in claim 15 wherein said intermediate portions of the flexible arms have respective surfaces bowed convexly relative to the substantially planar surface.

17. An electrical switch device as set forth in claim 15 wherein said intermediate portions of the flexible arms have respective surfaces bowed concavely relative to the substantially planar surface.

18. An electrical switch device as set forth in claim 15 wherein said intermediate portions of the flexible arms also are curved arcuately along the paths travelled by said opposing portions of the hub during said controlled rotary movement of the pawl means.

19. An electrical switch device as set forth in claim 18 wherein said resilient pressure means includes positive-stop latching means including a boss protruding integrally from the substantially planar surface and into the path of one of said distal end portions of the flexible arms during said controlled rotary movement of the pawl means.

20. An electrical switch device as set forth in claim 19 wherein said boss comprises a ramp-like body having a sloped surface disposed in the path of said one of the distal end portions of the flexible arms and terminating in a sheer end surface off which said one of the distal end portions flexingly drops into abutting relationship with said sheer end surface.

* * * * *